United States Patent [19]

Skalski

[11] Patent Number: 5,035,301

[45] Date of Patent: Jul. 30, 1991

[54] ELEVATOR SPEED DICTATION SYSTEM

[75] Inventor: Clement A. Skalski, Avon, Conn.

[73] Assignee: Otis Elevator Company, Farmington, Conn.

[21] Appl. No.: 375,429

[22] Filed: Jul. 3, 1989

[51] Int. Cl.[5] ..... B66B 1/30

[52] U.S. Cl. ..... 187/118

[58] Field of Search ..... 187/118, 115, 134; 318/561, 560, 116

[56] References Cited

U.S. PATENT DOCUMENTS 4,594,536 6/1986 Tamagaki ..... 318/561

4,751,984 6/1988 Williams et al. ..... 187/116

*Primary Examiner*—A. D. Pellinen

*Assistant Examiner*—W. E. Duncanson, Jr.

[57] ABSTRACT

The present invention is directed to an elevator speed dictation system for use in controlling the acceleration and deceleration of an elevator. During the acceleration phase, the speed dictation system of the present invention calculates a dictated acceleration value and a dictated velocity value, as well as a position value representative of where the elevator should be, based on the dictated acceleration and velocity values. The system provides a table for storing values of acceleration, velocity and position based on the dictated velocity values. The stored values of acceleration and velocity are used by the system for decelerating the elevator, with position being the index into the table. Since acceleration values are available from the table, system computation time, otherwise required for calculating acceleration from velocity, is saved. The system begins to decelerate the elevator upon the issuance of a stop control command (SCC). The present invention employs, inter alia, a distance error calculation in determining the SCC. The distance error calculation is based on the dictated position value and the actual distance traveled by the elevator. In this way, the distance error calculation compensates for various system errors.

11 Claims, 7 Drawing Sheets

ELEVATOR SPEED DICTATION SYSTEM

TECHNICAL FIELD

The present invention relates to elevator systems and in particular to elevator velocity control.

BACKGROUND ART

The need to control the velocity of an elevator is well known. Reference is had, for example, to assignee's U.S. Pat. No. 4,751,984 of Walter L. Williams, Donald G. McPherson & Arnold Mendelsohn entitled "Dynamically Generated Adaptive Elevator Velocity Profile" issued Jun. 21, 1988, as well as to the art cited therein.

As noted in the Williams et al. patent, automatic elevator operation requires the control of elevator velocity with respect to zero or stop, at the beginning and the end of a trip, to speeds therebetween, which minimize trip time while maintaining comfort levels and other constraints. The time change in velocity for a complete trip is termed a "velocity profile." Automatic elevator control further requires control of the distance travelled during a trip in order to accomplish a precision stop at the destination floor.

Certain velocity profile generation strategies may lead to control instabilities. A common strategy is to use a phase-plane control for precision stopping, wherein dictated velocity is a function of the distance to go to the landing. As the distance-to-go approaches zero, the slope of the velocity/distance curve approaches infinity ($\infty$). Using linear control theory, it can be shown that the slope of the phase-plane curve represents the position error gain for phase-plane control and is proportional to position loop bandwidth. For the speed control loop to track the dictated velocity profile with stability, its bandwidth must be greater by a significant factor than the bandwidth of the position control loop.

One strategy for reducing the required bandwidth is to limit the slope of the phase-plane velocity versus position profile (position error gain) to a maximum value, such that the position loop bandwidth is sufficiently lower than the velocity loop bandwidth.

Generally, the torque producing capability of elevator motors may vary with speed due to motor current, voltage, and/or power limitations. If the drive is not capable of maintaining the acceleration limit under all conditions due to these torque limits, some means of reducing the acceleration (and hence torque) in the corresponding portions of the velocity profile must be provided without compromising operation of the drive at its limit or complicating the profile generation more than necessary.

To avoid, inter alia, these problems, in Williams et al. each segment of the velocity profile was generated at one of the limits constraining the system; viz., at maximum jerk, maximum acceleration, maximum velocity, maximum position or loop gain, or maximum motor torque. The acceleration portion of the velocity profile preferably was generated in an open loop manner, beginning with constant (maximum) jerk, transitioning to constant (maximum) acceleration after an acceleration limit is attained, and jerking out (negative jerk) at a constant rate to maximum (contract) velocity when the maximum velocity is nearly attained However, although Williams et al. represented a very substantial advance in the art, it also was subject to improvement, to which the present invention is directed. The disclosure of the Williams et al. patent is incorporated herein by reference.

DISCLOSURE OF INVENTION

In the invention, at a speed close to the base speed of the motor, acceleration reduction preferably is used to keep power requirements well bounded without significantly compromising flight time. This is a form of acceleration profile adaptation based on speed.

Another type of adaptation also may be used. The acceleration and jerk limits for the profile may be adjusted in accordance with available torque. The torque requirements may be determined from the load weighing signal, which gives the load in the cab. The acceleration and jerk limits for the profile can then be adjusted accordingly.

Thus, the profile generator can be made adaptive by presetting the acceleration and jerk limits based on the load in the elevator cab. This can be done by a simple computation based on the load weight made at the beginning of a run. This could be done to permit the use of a smaller than usual drive system, if so desired.

The dictation system of the present invention is capable of generating for output high-quality velocity and acceleration signals. It is advantageous because it is highly structured in design, tolerant of significant computational errors, and is easily modified to handle unusual situations.

Therefore, it is an object of the present invention to produce a minimum-time velocity/acceleration profile, subject to the following constraints:

- contract speed(s) (as in Williams et al.);
- ride comfort constraints; i.e., acceleration and jerk limits (as in Williams et al.);
- drive torque and power limits (following to some degree Williams et al.); and
- compatibility with the drive system.

In addition, like Williams et al., the velocity-profile generation approach of the present invention preferably:

- provides for precision stopping at the destination floor and re-leveling;
- complies with the code required door zone and other terminal landing speed limits; and
- accommodates short runs where the contract speed is not reached, as well as very short runs where the "stop control command" (SCC) is reached before the velocity "VBASE" (described more fully below) is reached.

According to the invention and as part of the improvement to the approach of Williams et al., each segment of the velocity profile likewise is generated at one of the limits which constrain the system; viz., at maximum jerk, maximum acceleration, maximum velocity, maximum position or loop gain, or maximum motor torque. The acceleration portion of the velocity profile preferably is generated in an open loop manner, beginning with constant (maximum) jerk, transitioning to constant (maximum) acceleration after an acceleration limit is attained, and jerking out (negative jerk) at a constant rate to maximum (contract) velocity when the maximum velocity is nearly attained.

The invention may be practiced in a wide variety of elevator applications utilizing known technology, in the light of the teachings of the invention, which are discussed in detail hereafter.

Some of the technological advances achieved and/or followed in the preferred embodiment of the present invention are outlined below.

1. The velocity is stored in a table as a function of distance gone during acceleration. This table can be used in reverse to find dictation as a function of distance to go during deceleration. The new profile generator explicitly builds the velocity table from acceleration and jerk constraints. This means that acceleration corresponding to each velocity is known. The new profile generator stores acceleration information along with velocity information in tables having distance as the independent variable. Table entries are made during each processor cycle during acceleration. The acceleration table is used in reverse together with a numerical scaling to decelerate the elevator. Acceleration information is output by the profile generator at all times (acceleration, constant speed, deceleration). No numerical differentiation of velocity is used to find acceleration, except in special situations. This results in a high-quality acceleration signal. Also, processor time is saved.

2. The acceleration signal mentioned in "1" above can be blended with the velocity signal and the combination applied as dictation to a drive. This provides an "acceleration feedforward" that reduces velocity tracking time and thus makes the drive more responsive. The acceleration signal can also be applied in standard fashion to the torque input point of a drive (if available). A disadvantage of feedforward is that it makes the drive system more load sensitive. Load sensitivity can be compensated for, if a load weight signal is available. This may be accomplished by varying the proportional gain of the proportional-integral controller used in the drive as a function of load weight.

3. The new profile generator has a simple algorithm for computing stopping distance. The algorithm can be used for runs of all lengths. The stopping distance is computed based on the DICTATED profile.

4. The stopping distance in "3" is compared to DISTTG (distance to go; DRIVE OUTPUT COORDINATES) converted to DICTATION coordinates. The conversion is accomplished by subtracting the tracking distance error from DISTTG. In the new profile generator the distance error is not entered in terms of drive tracking delay and velocity. Instead, the actual, MEASURED, distance tracking error is used. The measurement is accomplished by using numerical integration of dictated velocity to find distance dictated. The DISTANCE GONE = LENGTH OF RUN − DISTTG, and
DISTANCE DICTATED − DISTANCE GONE = DISTANCE TRACKING ERROR.

The stop control command (SCC) is issued when the following condition is true:

STOPPING DIST. ≧ DISTTG − DIST. ERROR − (2 * VEL * DELTAT)

STOPPING DIST. is computed; DISTTG (distance to go) comes from a position transducer; DIST. ERROR is also measured; and the last term accounts for two cycles of delay in the processor system. VEL is dictated velocity and DELTAT is the processor cycle time (10–40 ms is typical).

5. The stop control command as defined in "4" usually cannot be issued perfectly. The distance range applicable to the velocity and acceleration tables will not match the distance to go. This problem becomes especially severe when the elevator is to be decelerated with look-ahead-distance-to-go (LADTG) rather than DISTTG as the independent variable. The problem is solved in the new profile generator by the introduction of a MULTIPLIER. This multiplier is a scaling factor that acts on the LADTG to make it equal to the distance range for the velocity and acceleration tables. Usually the MULTIPLIER is a number very close to one (1.0) for long runs. It may deviate significantly from one (1.0) for very short runs because of numerical errors. The MULTIPLIER assures that numerical errors, timing delays, etc., will not cause bizarre phase plane trajectories. The phase plane-control in the profile generator of the invention is self-correcting and robust because of the MULTIPLIER.

6. The look-ahead-distance-to-go (LADTG) is made adaptive in the new profile generator. It is not used for runs of less than 1000 mm (pure DISTTG is used). Further, as the end of a run is approached, LADTG has a "washout" term which is a function of DISTTG. As DISTTG approaches zero, a multiplier acts on the velocity dependent portion of LADTG to make that term less and less significant. Should the control overshoot and the DISTTG go negative, phase plane control reverts to pure DISTTG, rather than LADTG as the independent variable.

7. The profile design is modular, structured, and deterministic. Acceleration, jerk, and distance constraints permitting, it is capable of being altered after a run has begun The modular design makes design modifications relatively easy. Maintenance of the code and teaching of the design to new engineers is not complicated.

8. The profile generator can be made adaptive by presetting the acceleration and jerk limits based on the load in the elevator cab This is done by a simple computation based on load weight made at the beginning of a run. This could be done to permit use of a smaller than usual drive system Working of examples indicates that significant cost savings are possible with little degradation in overall service (traffic flow).

Other features and advantages will be apparent from the specification and claims and from the accompanying drawings, which illustrate two exemplary embodiments of the invention.

BEST MODES FOR CARRYING OUT THE INVENTION

As noted in Williams et al., in order to provide rapid, controlled and smooth motion control in an elevator, a velocity profile is generated which observes constraints regarding jerk, acceleration and equipment limitations. Typical, exemplary requirements for a high performance system are:

| | |
|---|---|
| RISE | up to 400 M |
| LOADS | 900 TO 3600 KG |
| SPEEDS | 2.5 to 10 M/S |
| ACCEL. | up to 1.5 M/S |
| JERK | up to 3.0 M/S |
| LEVELING | ±0.006 M |

Figure 1:
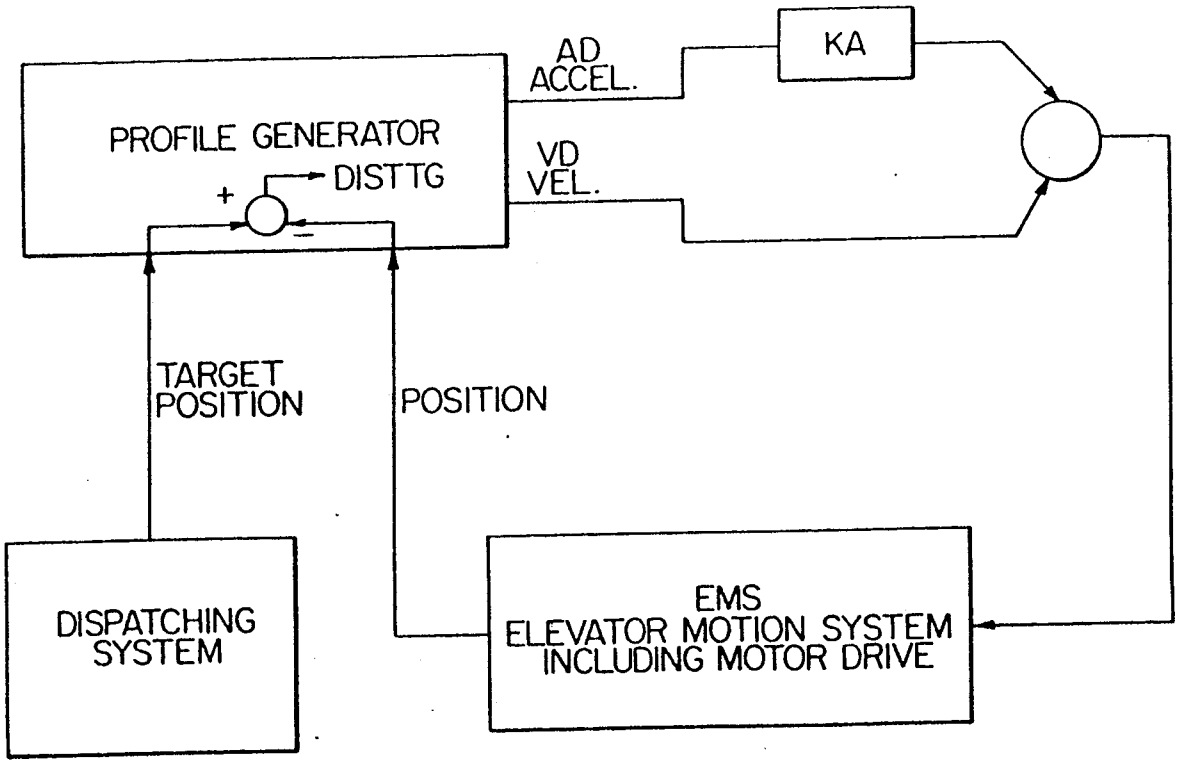
FIG. 1 is a simplified, block diagram of an exemplary embodiment of the elevator speed dictation system of the present invention.

An exemplary function block diagram of the invention is shown in FIG. 1. The profile generator (PROFILE GEN.) delivers a velocity signal "VD" and an acceleration signal "AD" to an elevator control system. The gain "KA" is used to control the blend of the acceleration signal to the velocity signal in a feed-forward control. Alternatively, the acceleration signal may be routed directly to the motor torque control point in the motor drive.

Sometimes limiters or filters (not illustrated) are used between the vD and AD signals and the elevator motion system ("EMS"). The EMS includes a position reference system, which feeds back the car position ("POSITION") to the profile generator.

The function of the profile generator is to bring the car to the target position within the acceleration and jerk constraints. These constraints may be fixed or they may be a function of available power, motor torque, etc. Just before and sometimes even during a run, the constraints may be changed. The profile generator is designed in a structured fashion, thereby permitting adaptation to changing circumstances, even when a run is under way.

The overall position control system should bring the car to its destination in a minimum amount of time, without vibrations or overshoot. The overall positioning accuracy sought is usually better than plus-or-minus three millimeters (±3 mm), although plus-or-minus six millimeters (±6 mm) is acceptable.

The acceleration limit is usually set by the available torque in the motor drive However, in an oversized system, passenger comfort may determine the acceleration limit.

In many systems the passenger comfort acceleration sets the acceleration with the motor torque limitation becoming a problem, only when the cab is empty or fully loaded. Most high-performance elevator systems are equipped with a load-weighing system.

Knowledge of elevator system parameters and the load weight permits computation of the maximum allowed acceleration based on the motor torque limit. Those skilled in the elevator art may routinely make this calculation, which is based on the mass of the hoistway equipment, the overbalance used for the counterweight, the load in the cab, and the available motor torque.

Part of the torque is used to offset unbalance and friction forces. The other part is used to accelerate or decelerate the system mass.

The profile construction strategy of the invention will now be described first in terms of typical profiles produced by the exemplary apparatus of the invention.

Figure 2:
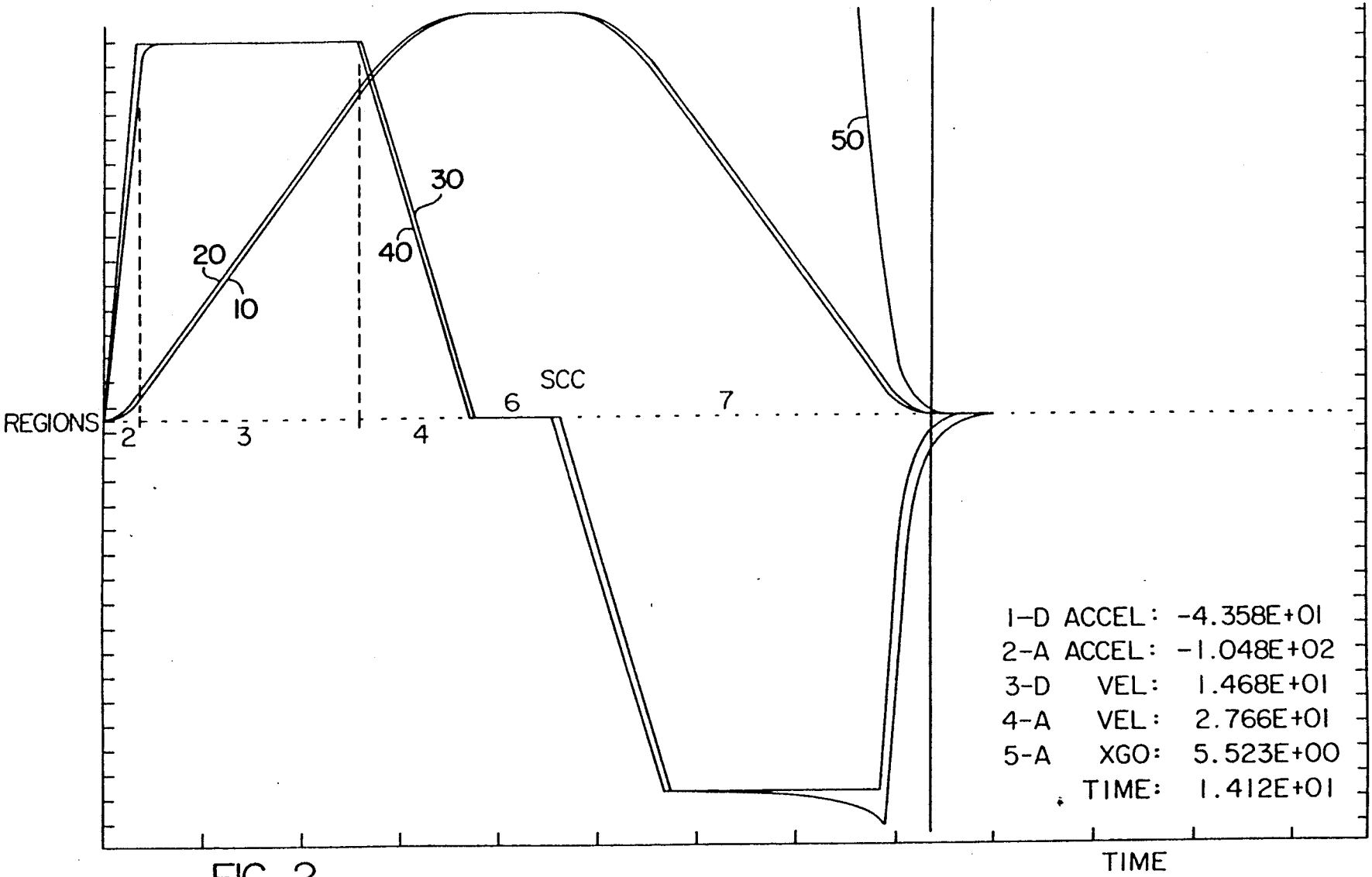
FIG. 2 is a graph of the velocity profile of the invention for an exemplary long run of an elevator car in accordance with the exemplary principles of the present invention. (It is noted that the numerical information on the lower, right side of the figure refers to the data values of the traces at the vertical cursor line located to the left side of the graphed, displayed traces; the same being true of FIGS. 3–6.)

FIG. 2 shows the dictated and actual velocity and acceleration for an exemplary long run. Understanding this profile set is important because all other profile sets are subsets of this one. As can be seen in FIG. 2 various regions 2–7, defined and explained more fully below, are marked.

The profiles for the first part of the run are developed on the basis of dictated acceleration. Dictated velocity is obtained by the numerical integration of the dictated acceleration. (Henceforth, as a matter of form and for simplicity purposes, dictated velocity and acceleration typically will be referred to without the adjective "dictated" being added.) The actual position, velocity, and acceleration are outputs from the EMS.

It is noted that the quantity target position-position=distance-to-go ("DISTTG"). A greatly amplified trace of "DISTTG" 50 is shown in FIG. 2.

The regions in FIG. 2 are defined as follows and illustrated in block form in FIG. 3:

| Region | Definition |
|---|---|
| 0 | zero speed |
| 1 | low level phase plane |
| 2 | constant jerk to prescribed acceleration |
| 3 | prescribed acceleration |
| 4 | constant jerk down to constant velocity |
| 5 | jerk level after generation of SCC |
| 6 | constant speed |
| 7 | phase plane |

Regions "0," "1," and "7" apply to runs of all lengths. Regions 0 and 1 are not shown explicitly on the profiles illustrated in FIGS. 2, etc., and the meaning of Region 1 is explained when the phase-plane Region 7 is explained.

In the profiles of FIG. 2 and FIGS. 4–6, the profile traces and the parameters they represent are tabulated below:

| Trace # | Parameter |
|---|---|
| 10 | velocity |
| 20 | velocity dictation |
| 30 | acceleration |
| 40 | dictated acceleration |
| 50 | distance to go (greatly magnified) |

FIG. 2 will now be discussed on a time-history basis. The elevator car is stopped. It then accelerates at "constant jerk" in Region 2 until the acceleration limit is reached.

The end of Region 3 is defined when "VBASE" is reached. "VBASE" can be the base velocity or speed of the motor or a lower speed. "VBASE" is subject to some variation, and, typically, it will be close to but a bit less than the base speed of the motor involved. A "jerk out" is then defined in Region 4 until maximum speed is reached in Region 6. Operation continues in Region 6, until the stop control command (SCC) is received.

Region 7 is then entered. In that region the velocity is commanded as a function of distance-to-go on the basis of a table of velocity versus distance built up for all travel in Regions 2–5. At the time the velocity table is being built, an acceleration table is also being built. Both the velocity and acceleration tables can be weighted, so that deceleration occurs in direct proportion to a set "DECELRATIO." The "DECELRATIO" is usually less than one ($<1.0$), but it may also be larger than one ($>1.0$).

Figure 3:
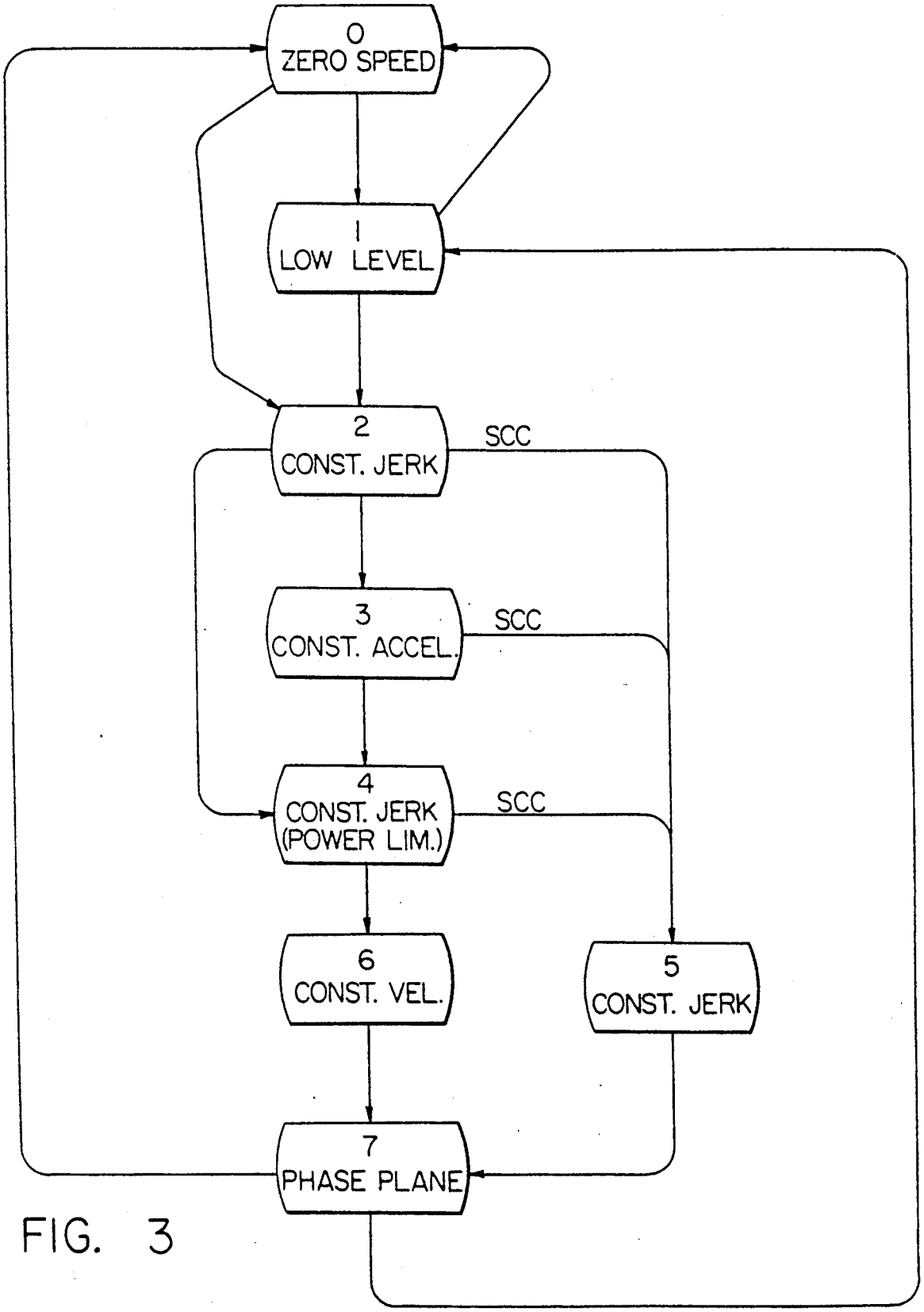
FIG. 3 is a flow chart showing the transitions between the regions of the velocity profile of FIG. 2, as well as of the velocity profiles of FIGS. 4–6, with Regions 0 (zero speed) and 1 (low level phase plane) not being illustrated for simplicity purposes in the velocity profiles.

The profile generator regions are illustrated in block form in FIG. 3. The transitions from Regions 1 to 0 and 0 to 1 are used at the beginning of a run for holding the elevator at the floor when the brake is lifted and the transition to Region 2 is about to commence. Upon receipt of SCC, it is possible to leave Regions 2–4 and enter Region 5.

Deceleration of the elevator occurs in Region 7 using phase-plane control for precision stopping, wherein dictated velocity is a function of the distance to go to the landing. The dictated velocity and acceleration used are retrieved from tables built in Regions 2–5. When the elevator has almost landed or during recovery from an overshoot, the low-level phase plane Region 1 is entered. The low-level-phase plane has a linear slope (velocity/DISTTG) in a range of, for example, one to four (1–4 $sec^{-1}$) 1/second.

Figure 4:
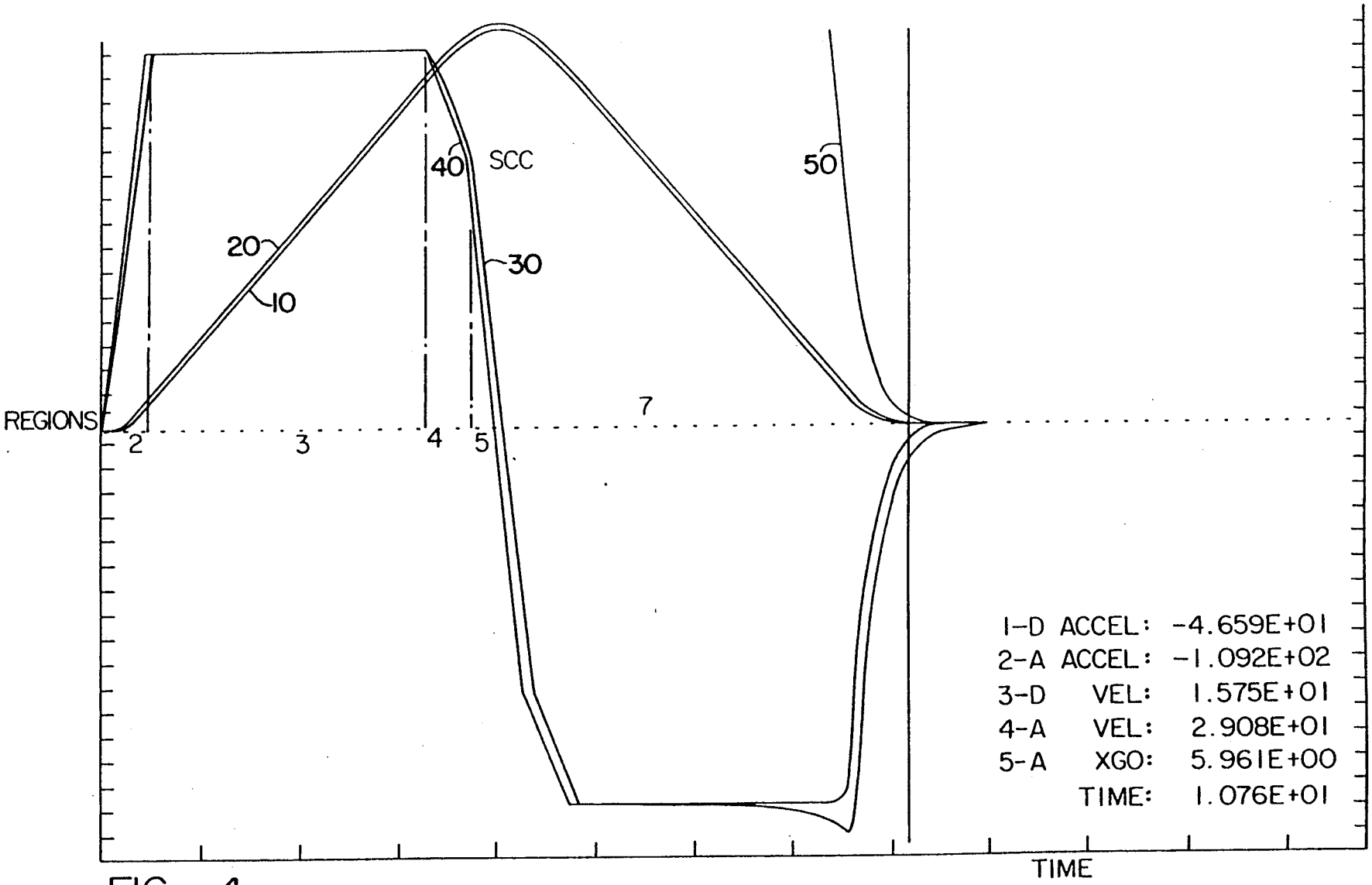
FIG. 4 is a graph of the velocity profile of the invention for an exemplary "Intermediate II" profile of the elevator car, in which the Intermediate II profile illustrates the situation wherein a transition to Region 5 occurs after a Stop Control Command (SCC).
Figure 5:
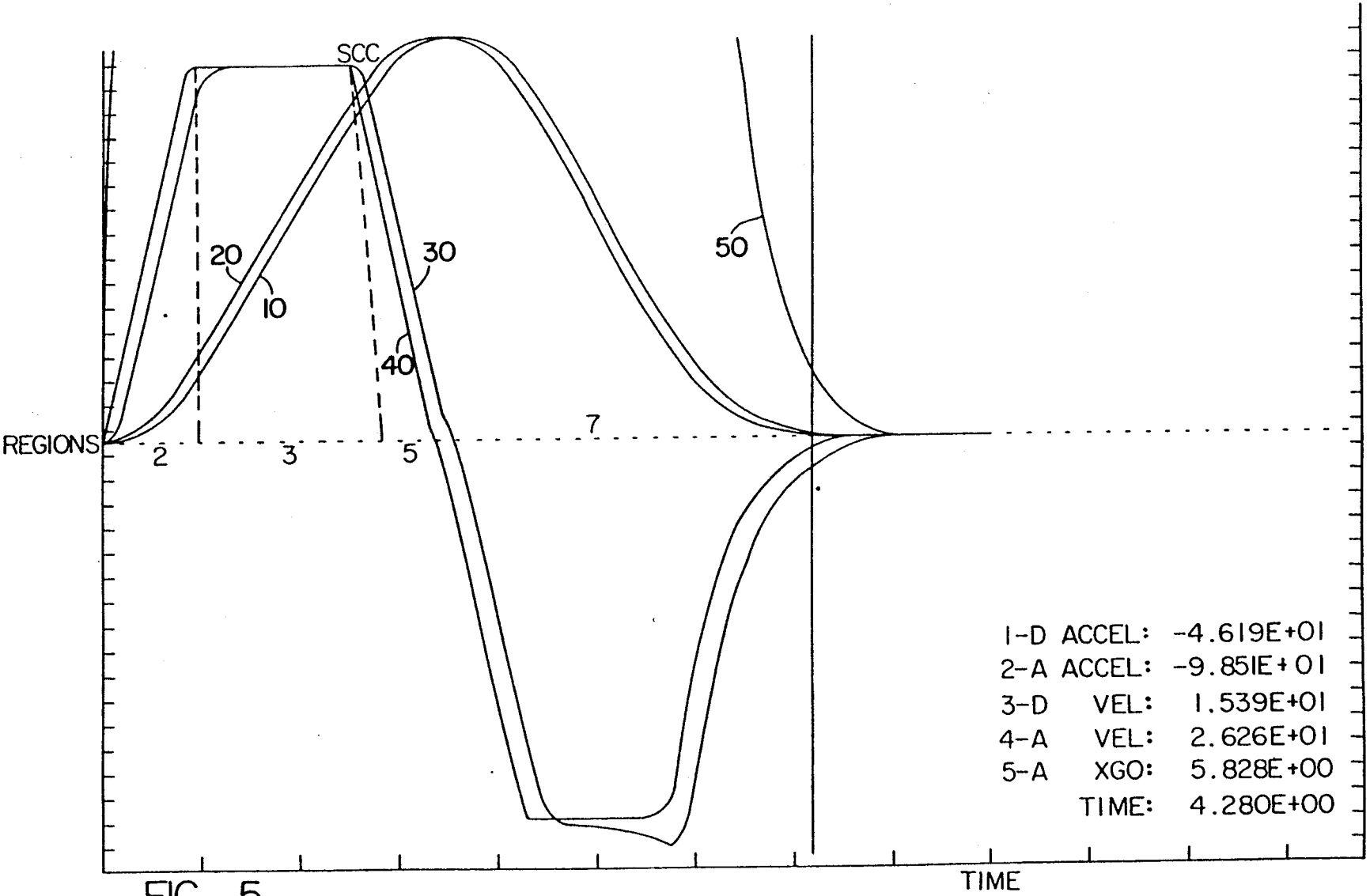
FIG. 5 is a graph of the velocity profile of the invention for an exemplary "Intermediate I" profile of the elevator car, in which the Intermediate I profile illustrates the situation wherein there is a transition from Region 3 to Region 5.
Figure 6:
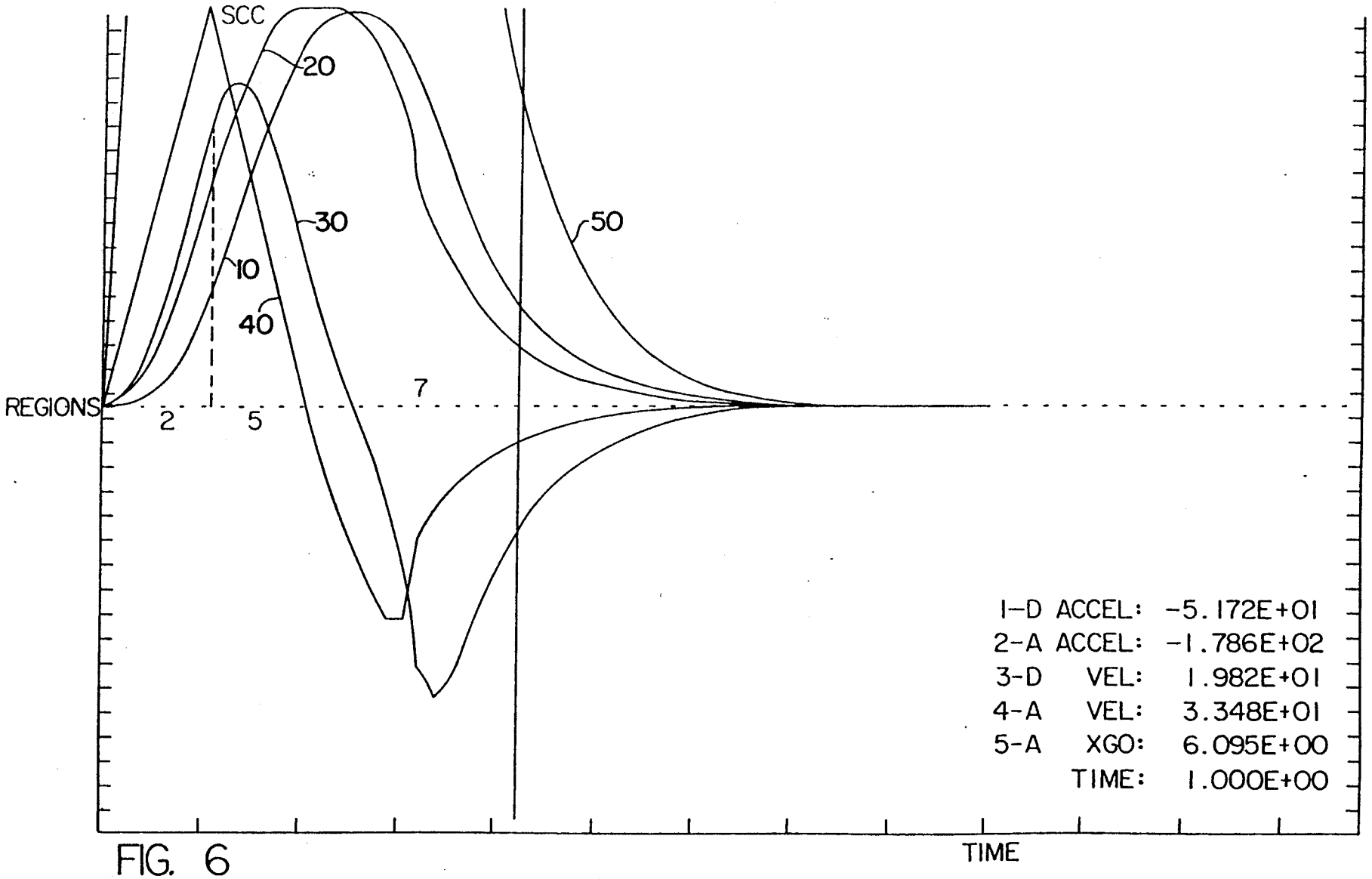
FIG. 6 is a graph of the velocity profile of the invention for an exemplary short run of the elevator car.

Actual operation for less than full-length runs is illustrated in FIGS. 4–6. FIG. 4 is termed "Intermediate II" because the transition to Region 5 occurs after SCC. FIG. 5 is an "Intermediate I" profile because a transition occurs from Region 3 to Region 5. This figure illustrates the typical operation for a one-floor run. FIG. 6 is a short run in which the acceleration limit, Region 3, is not reached, and, thus, transition occurs directly from Region 2 to Region 5.

Proper operation of the profile generator system requires careful attention to detail, especially if smooth, error tolerant operation is desired. These details are described below.

Major Operations in Profile Generation

The timed portions of the profiles are obtained by successive numerical integrations using the trapezoidal algorithm. This has the following general form:

$$X_n = X_{n-1} + (T/2)(dX_n/dt + dX_{n-1}/dt)$$

where—

$X_{n-1}$ is the previous value of $X_n$ (computed at time $t_{n-1} = t_n - T$); and T is the step size (cycle time, sampling rate).

The major operations other than generation of a timed profile are listed here. Those occurring in Regions 2–6 are:

1. Build the linear portion of the phase-plane table.
2. Build the phase-plane table in regions 2–5.
3. Compute the stopping distance (Regions 2, 3, 4, 6).
4. Determine the distance error and SCC.

The following operations are important in transitioning to, and operating in, Region 7 (phase plane):

1. Determine the "MULTIPLIER" for coordinate transformation.
2. Compute the Look-Ahead-Distance-To-Go ("LADTG") from DISTTG.
3. Interpolate the velocity and acceleration tables.
4. Transition to low-level phase plane at the end of the run.

Details of the foregoing operations are discussed below.

Phase Plane Table Building

The phase plane table is built dynamically in a microprocessor during the timed acceleration portion of the profile. As the acceleration and velocity dictation signals are computed each cycle, they are stored in a table together with the index and a corresponding distance. The table is built to satisfy the profile requirements in the phase plane deceleration region. At low speeds where VD≦LEVELVEL (elevator approaches the destination), the relationship between the dictated velocity and the distance-to-go is linear—

$$VD = K * DISTTG$$

The corresponding dictated acceleration is calculated as—

$$AD = K * VD$$

where K is the position loop gain (see FIG. 1). For standard profiles—

$$K = LEVELGAIN$$

For speeds where VD >LEVELVEL, the relationship between VD and DISTTG is nonlinear. The acceleration, velocity, and position entries in the table are obtained by successive integrations, and the table index is incremented each cycle.

Taking the DECELRATIO factor into account, the equations used for table building are:

$$\begin{aligned} &\text{If } VD_n \leqq LEVELVEL \\ \text{then } &- \\ &INDEX = n \\ &VTBL(n) = VD_n \\ &XTBL(n) = VD_n \div K \\ &ATBL(n) = VD_n * K \end{aligned}$$

However—

$$\begin{aligned} &\text{If } VD_n > LEVELVEL \\ \text{then } &- \\ &INDEX = n \\ &VTBL(n) = VD_n \\ &ATBL(n) = \tfrac{1}{2} * [ATBL(n-1) + AD_n * DECELRATIO] \\ &XTBL(n) = XTBL(n-1) + \tfrac{1}{2}T * \\ &\qquad [VTBL(n-1) + VD_n] \div DECELRATIO \end{aligned}$$

where —

$$LEVELVEL = AD_n * DECELRATIO \div K$$

Table building continues until the acceleration reaches zero, or, in other words, it is stopped for one of two reasons:

(1) Region 7 (phase-plane) is entered without going-through Region 6 (constant velocity); or (2) a transition is made to Region 6.

Stopping Distance and SCC Determination

Besides table building, computations preferably are being made during acceleration to determine the stopping distance based on the dictation. This stopping distance is correct if no time delays exist in the velocity control system.

Figure 7:
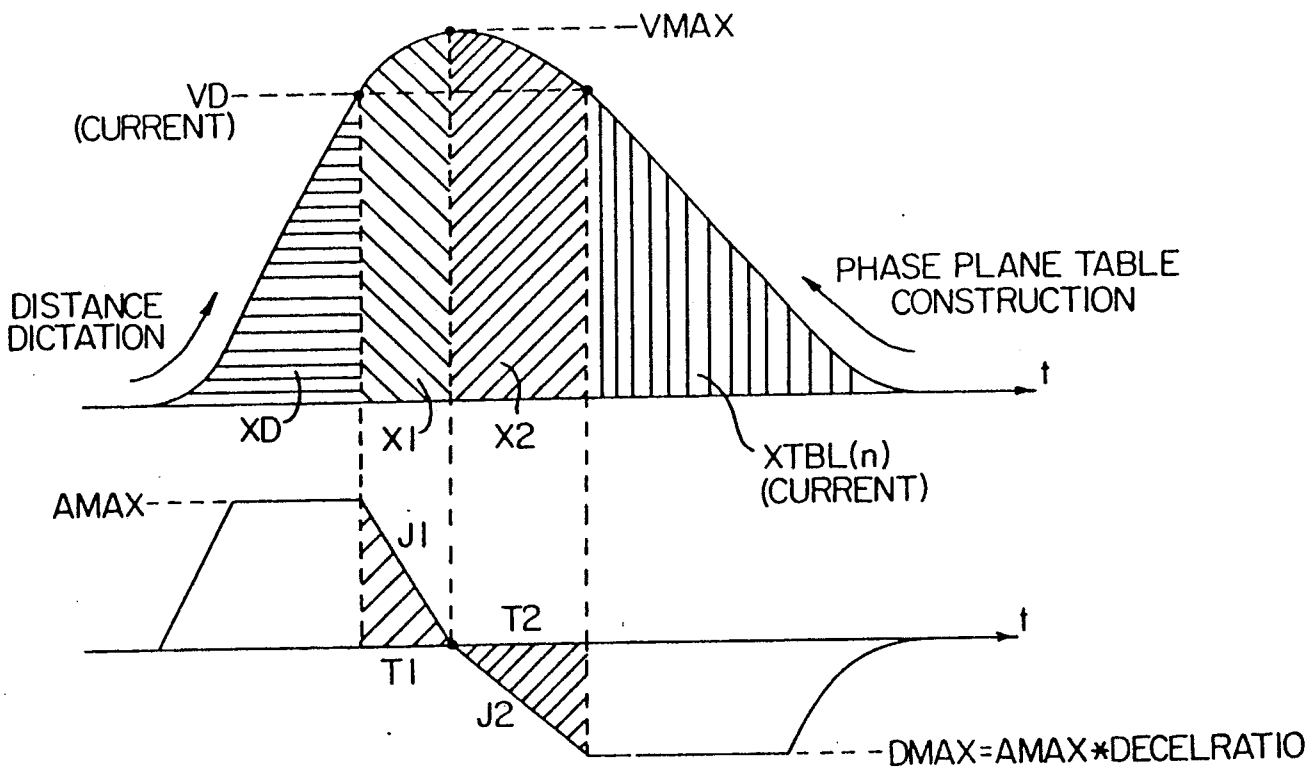
FIG. 7 is a comparative graph of exemplary velocity and acceleration curves used in the invention to find the stopping distance.

The following basic equations applied to FIG. 7 are used to compute the stopping distance when Region 6 (constant velocity) is not entered:

$$JD_n = J_0$$
$$AD_n = A_0 + J_0 * t$$
$$VD_n = V_0 + A_0 * t + \tfrac{1}{2} * J_0 * t^2$$
$$XD_n = X_0 + V_0 * t + \tfrac{1}{2} * A_0 * t^2 + 1/6 * J_0 * t^3$$

where—

$JD_n$, $AD_n$, $VD_n$ and $XD_n$ are the are the current dictated jerk, acceleration, velocity and distance, respectively (at time $t=t_n$); and $J_0$, $A_0$, $V_0$ and $X_0$ are the initial jerk, acceleration, velocity and distance, respectively.

If the SCC command is generated during the constant velocity portion (Region 6), then the stopping distance is determined only by the current distance stored in the table. Otherwise, the stopping distance is given, after some derivation, by:

$$STOP.DIST = XTBL(n) + (VD_n * AD_n / J_0 + \tfrac{1}{3} * AD_n^3 / J_0^2) * (1 + 1/DECELRATIO)$$

The stopping distance must be compared not to the actual distance-to-go but to that value corrected for delays. The following equality defines the stop control command (SCC) point, when processor system delays are neglected.

$$STOP.DIST = DISTTG - DIST.ERR$$

where $$DISTTG = TARGET.POS - CURRENT.POS$$
$$DIST.ERR = DIST.DICT - DIST.GONE$$
$$DIST.GONE = CURRENT.POS - STARTING.POS$$

The dictated distance "DIST.DICT" is computed by integrating the dictated velocity, "VD":

$$DIST.DICT = XD_n = XD_{n-1} + [VD_n + VD_{n-1})9 * \tfrac{1}{2}T$$

In a real system implementation, the information processing delays in the position loop become significant and must be compensated. The equality given above for "STOP.DIST" is modified as indicated for implementation in a real system:

$$STOP.DIST \geqq DISTTG - DIST.ERR - n * VD * T$$

The number n=2 is usually used to account for a delay of two processor cycles.

Phase Plane Deceleration of Elevator

In the phase plane region, a linear interpolation technique preferably is used to calculate the acceleration and velocity signals from the previously constructed tables. The distance-to-go to the target landing is used to index the tables.

Table building and determination of SCC have been described to this point The matter of transitioning to Region 7 (phase plane) will now be addressed At the transition to Region 7, the dictated velocities are inherently matched (AD=0).

Distances, however, may not be matched, especially since a coordinate transformation is introduced. Distance control is shifted from distance-to-go to Look-Ahead-Distance-To-Go (LADTG) The LADTG used here is a variant of a similar quantity described in the Williams, et al, U.S. Pat. No. 4,751,984, referred to above.

LADTG as defined below is used for the proper operation of the phase plane control, especially as the target landing is approached The RATIO is used to blend LADTG into DISTTG at the target landing. The $VD_{n-1} * T_c$ term is identical to that of Williams, et al. The MULTIPLIER is used to assure that LADTG matches the last distance entry stored in the phase plane tables.

$$LADTG = (DISTTG - COMPENSATION) * MULTIPLIER$$

where—

$$COMPENSATION = VD_{n-1} * T_c * RATIO$$

$T_c$—approximates the position loop delay and is a constant, which is adjustable in the EMS.

As the dictated velocity decreases to zero, LADTG approaches the value of DISTTG The rate at which the COMPENSATION term is reduced to zero is further controlled by the RATIO factor.

As the elevator approaches the destination floor, the value of RATIO must be gradually reduced ("washed-out") from one to zero (1 to 0) Consequently, RATIO is defined as follows:

If DISTTG>WDIST then RATIO=1, else RATIO=DISTTG÷WDIST, where "wash-out distance" (WDIST) is:

WDIST=LEVELVEL+LEVELGAIN

A linear definition is given here for RATIO. However, a nonlinear definition may be more useful in some circumstances. This is illustrated in the programmed simulation discussed below.

The MULTIPLIER is calculated only once, as the profile enters the phase plane deceleration region. It then remains constant until the end of the run.

$$MULTIPLIER = XTBL(M) \div DISTTGT$$

where—

XTBL(M)—is the last distance stored in the table, and

DISTTGT—is the actual distance-to-go at the transition point.

At the transition to the phase plane, LADTGT is forced to match the last phase plane entry:

$$LADTGT = XTBL(M)$$

Subsequently computed LADTGs are then scaled by the value of the MULTIPLIER, as shown above.

For best deceleration control, MULTIPLIER values close to unity or one (1.0) are desirable.

The dictated acceleration AD and velocity VD are calculated from the phase plane table using a linear interpolation technique. LADTG is used as an indexing reference.

$$AD = \{A - [(X - LADTG) \div (X - X1)] * (A - A1)\} * MULTIPLIER$$

$$VD = V - [(X - LADTG) \div (X - X1)] * (V - V1)$$

where—

$$A = ATBL(n),\ V = VTBL(n),\ X = XTBL(n)$$
$$A1 = ATBL(n-1),\ V1 = VTBL(n-1),\ \text{and}$$
$$X1 = XTBL(n-1)$$

After the entries in the phase table are almost used up, a linear phase plane trajectory is used based on LADTG. If an overshoot occurs, similar control is used and DISTTG is used rather than LADTG. The equations applicable after leaving the phase plane table but before the target landing are:

$$VD = LADTG * K$$

$$AD = -VD * K * MULTIPLIER$$

where K = the position loop gain.

If the target landing is overshot, then Region 1 (low-level phase plane) is entered to bring the car back to the landing. However, the acceleration signal, if used for feed-forward control, is modified after the zero crossing. "AD" should either be set to zero or computed by the numerical (time) differentiation of VD:

$$AD = [VD(n) - VD(n-1)] \div T$$

where T = cycle time of processor.

Profile Simulation

An exemplary simulation for the profile generating system written in BASIC (Microsoft's "QuickBASIC 4.0") is presented below. In the program graphics routines used with the simulation are unnecessary for this disclosure and have been removed for purposes of simplicity. The BASIC used here is structured and reads very much like ordinary English or math statements (i.e., /=divide; *=multiply;=exponent; etc.) "Quick BASIC" allows simple calls to subroutines. Also, program control may be shifted by a "GO TO" to a named label.

As can be seen, the first part of the program consists of declarative statements and comments. Next, parameters for the profile are set and preliminary computations are made. This type of operation can take place adaptively in a real elevator control to adjust for changing conditions.

Variables are initialized and flags are set. Similar operations occur in the control code used to run an elevator.

The distance for the profile is entered.

The block of code called "READ PHASE PLANE TABLE" is bypassed, and control shifts to a point labeled "TIMED.PROFILE." Profile generation takes places on a region by region basis as described previously. "VD" and "AD" are found by numerical integration. Building of the phase-plane tables takes place next. There are then operations to find the dictated distance, "DIST.DICT," by numerical integration and the distance error, "DIST.ERR"

Next, the stopping distance is found by a call to the subroutine called "STOPD." Then a check is made if SCC% = 1, meaning a stopping sequence should be initiated. The "SCC" determination is based on "DISTTG," as computed below, "DIST.ERR," and the dictated velocity "VD."

Control then shifts to the label "VELCONTROL:". The subroutine "VELCONTROL" is called to simulate in simplified form the operation of the EMS of FIG. 1 (a model of a DC drive may be used). This subroutine provides an update to the actual velocity and acceleration. Importantly, it provides the "DIST.GONE" (actual distance traveled by the elevator). From "DIST.GONE" the "DISTTG" is computed.

The simulation continues with a timed-based profile being generated until SCC% = 1. The stopping sequence then commences. For other than a long run, this includes further operation with a timed profile, until a condition of zero acceleration is reached. This is analogous to operation in Region 5, which is commented as "SCC ACTIVE".

When AD = 0, control shifts to the label near the beginning of the program entitled "PP.PROFILE"—READ PHASE PLANE TABLE." The distance range for the tables is first matched to the "LADTG" (found by a call to a subroutine). The match is made using the parameter called "MULTIPLIER." The "MULTIPLIER" is computed only once during a run. Next, reading of the velocity and acceleration tables occurs, using an interpolation algorithm.

The phase plane changes to a straight line definition when the table index N% = 1 (table exhausted). A region called "LOWLEV.PROFILE" is then defined. The simulation differs from the actual profile generator in that Region 1 here applies only to the end of the run and that the same phase-plane slope is used for table continuation and for recovery from overshoots.

- EXEMPLARY BASIC PROGRAM -

```
DECLARE SUB LADISTANCE (LADTG, MULTIPLIER, RDISTANCE,
        distance, VD, DISTTG, DELTATC, LOWLEV%)
DECLARE SUB VELCONTROL (VDICT!, AM!, VM!, XM!, DT!, T!,
        RESETFLAG%, DRIVELIM)
DECLARE SUB STOPD (XSTART, VSTART, AD, XSTOP, VMAX,
        DECELRATIO, JERK)
'                    TITLE: NEWVEL
'          COPYRIGHT: OTIS ELEVATOR COMPANY
'              DATE WRITTEN: 2/15/88
'
'              LANGUAGE: QUICK BASIC 4.0
' PURPOSE: SIMULATE NEW MCSS NORMAL PROFILE GENERATOR
'
'***** ARRAYS FOR PHASE PLANE TABLE IN MAIN MODULE
'
DIM PPV(600), PPS(600), PPA(600)
'
'***** ARRAYS FOR GRAPHING SUBROUTINE GRAF1
'
DIM PARR(4, 600), SF1(4), SF(4), GAIN(4)
'
'***** INIT SCREEN, SET SCREEN TYPE TO 2 (CGA), 9 (EGA),
'      OR 10 (MONO)
'
CLS : SCREEN 0, 0, 0: COLOR 7, 0, 0: KEY OFF: SCRN = 9
'
'** SET PARAMETERS FOR PROFILE AND COMPUTE RELATED VALUES
'
ACCELLIMIT = 1200  'ACCELERATION LIMIT
JERKLIMIT = 2400   'JERK LIMIT DURING ACCELERATION
DECELRATIO = 1!    'RATIO OF DECELERATION TO ACCELERA-
'                   TION
VELLIMIT = 6000  'MAX SPEED, CONTRACT VELOCITY, ETC.
LEVELGAIN = 3!   'LEVELING GAIN (POSITION LOOP GAIN)
DELTAT = .04: DELTATC = .1:   'CYCLE TIME AND TIME DELAY
'                              IN VELOCITY CONTROL
STOPTOLV = 40: STOPTOLS = 6:  'THESE DEFINE CONDITION FOR
'                              BRAKE DROP
VELLIMIT1 = 1.01 * VELLIMIT   'USED FOR SPEED CHECK
VBASE = 4800  'VELOCITY AT WHICH ACCELERATION IS REDUCED
'              AT JERKBASE RATE
'              VBASE<VELLIMIT TO BE EFFECTIVE
DELTAACCEL5 = JERKLIMIT * DELTAT / 2  'ACCEL. INCRE. FOR
'                                      TESTING ACCEL.
'                                      REDUCTION
'
'***** INITIALIZE VARIABLES AND SET FLAGS
REGION% = 2  '  START RUN IN REGION 2
RESETFLAG% = 1 ' CAUSE VELCONTROL SUBROUTINE TO INITIAL-
IZE ON FIRST PASS
TSTOP = 999   ' FLAG AND REGISTER FOR STOPPING TIME
'               WITHIN STOPTOLS AND STOPTOLV
```

```
VD = 0: AD = 0 '  INITIAL DICTATED VELOCITY AND ACCELERA-
'                TION
BUILD.TABLE% = 1  ' TABLE IS BUILT WHEN RUN STARTS UNTIL
'                   AD = 0
READ.TABLE% = 0   ' TABLE IS READ DURING PHASE PLANE
'                   DECELERATION TO LANDING
SCC% = 0          ' STOP CONTROL COMMAND = 1 STARTS
'                   STOPPING SEQUENCE
DIST.GONE = 0     ' START AT ZERO POSITION
CLOCK = 0         ' START AT ZERO TIME
PPI% = 0          ' INITIAL INDEX FOR TABLE
PPV(PPI%) = 0: PPS(PPI%) = 0: PPA(PPI%) = 0 ' INITIAL
'                                            VALUES OF
'                                            TABLE
MATCHFLAG% = 1  'FLAG TO COMPUTE MULTIPLIER ON FIRST PASS
'                READING TABLE
MULTIPLIER = 1  'USED FOR PERFECT MATCH OF VELOCITY TABLE
'                TO CURRENT VELOCITY
LOWLEV% = 0     'LOWLEVEL PHASE PLANE WHEN LOWLEV%=1,
'                NO LOWLEVEL OTHERWISE
LLTIME% = 0     'FLAG TO CAPTURE START OF LOW LEVEL
'                OPERATION
VELMAXFLAG% = 0 'FLAG TO CONTROL PROFILE WHERE VELMAX(SUB
'                STOPD)DETERMINES SCC
distx = 0
'
'BRAKE LIFTED AT START OF RUN; BRAKE DROPPED AT T=FLTTIME
'
'***** PARAMETERS REQUIRED FOR GRAF SUBROUTINE
'
SP = 1: FOR I = 0 TO 3: GAIN(I) = 1: NEXT I: GAIN(4) =
100
XSCALE = 1: XSTART = 0
FOR I = 0 TO 4: PARR(I, 0) = 0: NEXT I
'
'SCREEN PRINT OF PARAMETERS AND INPUT OF RUN DISTANCE
'
'
LOCATE 10, 1: INPUT "DISTANCE FOR RUN (mm) (3658 mm
default)=  "; distance
IF distance = 0 THEN distance = 3658
DISTTG = distance
RUN.DISTANCE = distance
LOCATE 12, 1: PRINT "DISTANCE FOR RUN =  ", distance
'
'
GOTO TIMED.PROFILE
'***** GOTO TIMED PROFILE ******************************
'
PP.PROFILE:
'***** READ PHASE PLANE TABLE ***************************
'
IF READ.TABLE% = 0 THEN
     GOTO TIMED.PROFILE
```

```
ELSEIF LOWLEV% = 1 THEN
     GOTO LOWLEV.PROFILE
END IF
'
' READ VELOCITY AND ACCELERATION FROM PHASE PLANE TABLE
'
BUILD.TABLE% = 0

' GO COMPUTE LADTG
'
CALL LADISTANCE(LADTG, MULTIPLIER, RDISTANCE, distance,
VD, DISTTG, DELTATC, LOWLEV%)
'
'MATCH OF TABLE TO LADTG
'
IF MATCHFLAG% >= 1 THEN
        MULTIPLIER = PPS(PPI%) / LADTG
        MATCHFLAG% = 0
        LADTG = PPS(PPI%)
        END IF
'
'
DO UNTIL PPS(PPI% - 1) <= LADTG
PPI% = PPI% - 1
IF PPI% <= 1 THEN
     LOWLEV% = 1
     GOTO LOWLEV.PROFILE
END IF
LOOP
'
'
SRATIO = (PPS(PPI%) - LADTG) / (PPS(PPI%) - PPS(PPI% -
1))
VD = (PPV(PPI%) - (PPV(PPI%) - PPV(PPI% - 1)) * SRATIO)
AD = -(PPA(PPI%) - (PPA(PPI%) - PPA(PPI% - 1)) * SRATIO)
* MULTIPLIER
'
'
GOTO VELCONTROL
'***** GOTO VELCONTROL SIMULATION **********************
'
LOWLEV.PROFILE:
'***** CONTINUE PHASE PLANE AT END OF RUN ***************
'
CALL LADISTANCE(LADTG, MULTIPLIER, RDISTANCE, distance,
VD, DISTTG, DELTATC, LOWLEV%)
'
VD = LADTG * LEVELGAIN
AD = -VD * LEVELGAIN * MULTIPLIER
'
GOTO VELCONTROL
'***** GOTO VELCONTROL SIMULATION **********************
'
'
```

```
TIMED.PROFILE:
'***** GENERATE TIMED PROFILE DURING AD AND *************
'***** WHILE RUNNING AT CONTRACT (CONSTANT) SPEED *******
'

ON REGION% GOTO REGION2, REGION2, REGION3, REGION4,
REGION5, REGION6
'
'

REGION2:            'START HERE --- JERK IS CONSTANT
'
JERK = JERKLIMIT
'
'***** VERY LOW SPEED PROFILE SETS VELMAXFLAG% **********
'****** (VELMAX COMES FROM STOPPING DISTANCE SUB-
'        -ROUTINE) ******
'
IF VELMAX >= VELLIMIT - AD * DELTAT THEN
     VELMAXFLAG% = 1
     REGION% = 4
     GOTO REGION4
END IF
'
IF AD >= ACCELLIMIT THEN
     REGION% = 3
     GOTO REGION3
ELSEIF SCC% = 1 THEN
     REGION% = 5
     GOTO REGION5
END IF
GOTO START.INTEG
'
REGION3:            'CONSTANT ACCELERATION
'
JERK = 0
AD = ACCELLIMIT
'
IF VELMAX >= VELLIMIT - AD * DELTAT THEN
     VELMAXFLAG% = 1
     REGION% = 4
     GOTO REGION4
END IF
'
IF VD >= VBASE THEN
     REGION% = 4
     GOTO REGION4
ELSEIF SCC% = 1 THEN
     REGION% = 5
     GOTO REGION5
END IF
GOTO START.INTEG
'
REGION4:          'HIGH SPEED ACCELERATION REDUCTION
'
'***** COMPUTE JERK DYNAMICALLY *************************
```

```
'
JERK = -AD ^ 2 / (2 * (VELLIMIT - VD))
DELTAACCEL = -JERK * DELTAT / 2
'
IF VD >= VELLIMIT1 OR AD <= DELTAACCEL THEN
     REGION% = 6
     BUILD.TABLE% = 0
     DIST.ERRMAX = DIST.ERR
     GOTO REGION6
ELSEIF SCC% = 1 THEN
     REGION% = 5
     GOTO REGION5
END IF
GOTO START.INTEG
'
REGION5:       'SCC ACTIVE
'
JERK = -JERKLIMIT
'
IF AD < DELTAACCEL5 THEN
      JERK = 0
      AD = 0
      READ.TABLE% = 1
      BUILD.TABLE% = 0
      END IF
GOTO START.INTEG
'
REGION6:         'RUN AT CONTRACT SPEED
'
JERK = 0
AD = 0
VD = VELLIMIT
IF SCC% = 1 THEN
     READ.TABLE% = 1
     GOTO PP.PROFILE
END IF
'
START.INTEG:
'***** FIND DICTATED AD AND VD FROM JERK ****************
LOCATE 17, 1: PRINT "REGION =    ", REGION%, SCC%,
DIST.GONE
'
PREVA = AD
AD = AD + JERK * DELTAT
IF AD > ACCELLIMIT THEN AD = ACCELLIMIT
IF AD < 0 AND READ.TABLE% = 0 THEN AD = 0
VD = VD + ((AD + PREVA) / 2) * DELTAT
'
'***** BUILD PHASE PLANE TABLE DURING ACCELERATION ******
'
IF BUILD.TABLE% = 1 THEN
     PPI% = PPI% + 1
     PPV(PPI%) = VD
ELSEIF READ.TABLE% = 1 THEN
```

```
     GOTO PP.PROFILE
ELSE
     GOTO STOPDIST
END IF
'
'**** BUILD TABLE ON STRAIGHT LINE TRAJECTORY -
'     - TEST FOR LOW SPEED PROFILE **********************
'
LEVELVEL = (DECELRATIO * (AD + J * DELTAT)) / LEVELGAIN
RDISTANCE = LEVELVEL / LEVELGAIN' DISTANCE FOR WASHOUT
RATIO IN LADTG
IF PPV(PPI%) < LEVELVEL AND SCC% = 0 AND VELMAXFLAG% = 0
THEN
     PPS(PPI%) = PPV(PPI%) / LEVELGAIN
     PPA(PPI%) = PPV(PPI%) * LEVELGAIN
ELSE
     PPS(PPI%) = PPS(PPI% - 1) + (PPV(PPI%) + PPV(PPI% -
1)) * DELTAT / (2 * DECELRATIO)
     PPA(PPI%) = (AD * DECELRATIO + PPA(PPI% - 1)) / 2
     END IF
'
DIST.DICT = DIST.DICT + (PPV(PPI%) + PPV(PPI% - 1)) *
DELTAT / 2
DIST.ERR = DIST.DICT - DIST.GONE
'
STOPDIST:
'***** FIND STOPPING DISTANCE TO DETERMINE SCC **********
'
IF SCC% <> 0 THEN GOTO VELCONTROL
'
' COMPUTE STOPPING DISTANCE
'
IF REGION% = 6 THEN
     STOPDIST = PPS(PPI%)
     DIST.ERR = DIST.ERRMAX
ELSE
     CALL STOPD(PPS(PPI%), VD, AD, STOPDIST, VELMAX,
DECELRATIO, -JERKLIMIT)
END IF
' CHECK FOR STOP CONTROL-POINT
'
'
IF STOPDIST >= DISTTG - DIST.ERR - 2 * DELTAT * VD THEN
     SCC% = 1
ELSE
     SCC% = 0
END IF
'
VELCONTROL:
' ***** SIMULATE VELOCITY CONTROL SYSTEM ****************
'
' SIMULATE VELOCITY CONTROL (DC-DBSS)
'
CALL VELCONTROL(VD, AM, VACTUAL, DIST.GONE, DELTAT,
CLOCK, RESETFLAG%, DRIVELIM)
DISTTG = distance - DIST.GONE
'
```

```
LOCATE 20, 1: PRINT USING "ELAPSED TIME = ##.##"; CLOCK
'
'***** PREPARE FOR GRAPHING OUTPUT *********************
'FILL PLOT ARRAY
'
PARR(0, SP) = AD
PARR(1, SP) = AM
PARR(2, SP) = VD
PARR(3, SP) = VACTUAL
PARR(4, SP) = DISTTG
'
'
LOCATE 18, 5: PRINT "DISTTG, DIST.ERR = ", INT(DISTTG),
INT(DIST.ERR)
'
'SET SCALE FACTORS FOR PLOT
'
FOR I = 0 TO 4
IF ABS(PARR(I, SP)) > SF1(I) THEN
     SF1(I) = ABS(PARR(I, SP))
END IF
NEXT I
SP = SP + 1
'
'EQUALIZE SCALE FACTORS
'
IF SF1(0) > SF1(1) THEN SF1(1) = SF1(0) ELSE SF1(0) =
SF1(1)
IF SF1(2) > SF1(3) THEN SF1(3) = SF1(2) ELSE SF1(2) =
SF1(3)
'
'***** PROCESS SIMULATION CONTINUATION AND TERMINATION **
'
IF VACTUAL <= STOPTOLV AND DISTTG <= STOPTOLS AND TSTOP
= 999 THEN
     TSTOP = CLOCK + 1
     FLTTIME = CLOCK
ELSEIF DISTTG <= -76 THEN
     GOTO FINISH
     FLTTIME = 0
END IF
'
'
IF CLOCK < TSTOP THEN
     IF BUILD.TABLE% = 1 AND READ.TABLE% = 0 THEN
          GOTO TIMED.PROFILE
     ELSEIF BUILD.TABLE% = 0 AND READ.TABLE% = 0 THEN
          GOTO TIMED.PROFILE
     ELSE
          GOTO PP.PROFILE
     END IF
END IF
'
FINISH:
'***** STOP SIMULATING AND START GRAPHING *************
```

```
'
IF LOWLEV% = 1 AND LLTIME% = 0 THEN
     LOCATE 22, 1, 0
     PRINT USING "LOW LEV AT ##.##"; CLOCK
     LLTIME% = 1
END IF
'
LOCATE 21, 1: PRINT USING "FLIGHT TIME = ##.##"; FLTTIME
LOCATE 24, 1, 1: PRINT "PRESS ANY KEY FOR PLOT...";
BEGIN: X$ = INKEY$: IF X$ = "" THEN GOTO BEGIN
'
'***** CALL THE GRAPHING SUBROUTINE *********************
'
'CALL GRAF1(PARR(), GAIN(), SF(), SF1(), XSCALE, XSTART,
SCRN, SP, DELTAT)
END
'
SUB LADISTANCE (LADTG, MULTIPLIER, RDISTANCE, distance,
VD, DISTTG, DELTATC, LOWLEV%)
'
LOCATE 16, 5: PRINT "multiplier= "; MULTIPLIER
'***** DESCRIPTION *****
'  LOOK AHEAD DISTANCE TO GO COMPENSATES FOR SOME CONTROL
'     SYSTEM DELAYS
'   IT IS DISABLED FOR THE CONDITIONS INDICATED BELOW
'    THE MULTIPLIER IS REQUIRED FOR MATCHING OF DISTANCES
'     PRIOR TO READING OF THE PHASE PLANE TABLE
'
'
IF distance > 1000 AND VD > 0 AND LOWLEV% = 0 THEN
     IF DISTTG < RDISTANCE THEN
          RATIO = ABS(DISTTG / RDISTANCE) ^ .25
     ELSE
          RATIO = 1
     END IF
     VELDEL = VD * DELTATC * RATIO
ELSE
     VELDEL = 0
END IF
'
LADTG = (DISTTG - VELDEL) * MULTIPLIER
'
'
END SUB
'
SUB STOPD (XSTART, VSTART, AD, XSTOP, VMAX, DECELRATIO,
JERK)
'COMPUTATIONS RELATED TO STOPPING DISTANCE SEQMENT
'
'The computation is performed in two parts: 1) From
'     VSTART (jerkout point) to the velocity peak VMAX.
'     2) From VMAX back to a speed equal to VSTART.
'     It can be shown that the time in the second region
'     is equal to the time in the first region divided by
'     the DECELRATIO.  XSTART is the distance stored away
'     in the distance table as PPS(PPI%).
```

```
'
'The equations for velocity and distance given below are
'    based on successive integration of jerk to yield
'    acceleration, velocity, and distance.
'
T = -AD / JERK
T2 = T * T
T3 = T2 * T
VMAX = VSTART + AD * T + JERK * T2 / 2
X2 = XSTART + VSTART * T + AD * T2 / 2 + JERK * T3 / 6
'
'
JERKDECEL = JERK * DECELRATIO ^ 2
T = T / DECELRATIO
T3 = T ^ 3
XSTOP = X2 + VMAX * T + JERKDECEL * T3 / 6
'
END SUB
'
SUB VELCONTROL (VDICT, AM, VM, XM, DT, T, RESETFLAG%,
DRIVELIM) STATIC
'This is a simple DC direct drive model that includes
'    torque limiting (expressed in acceleration units)
'    and generation of a drive limit signal.
'The driven load is assumed to be a pure inertia and a
'    proportion-integral controller is used.
' ***** see last portion of subroutine for model
'    description *****
'VDICT= VELOCITY DICTATION
'AM= MACHINE ACCELERATION
'VM= MACHINE VELOCITY
'XM= MACHINE POSITION
'INITIAL CONDITIONS ON INTERNAL STATE VARIABLE EG1=0
'DT= CYCLE TIME
'T= ELAPSED TIME
'TF= TIME CONSTANT OF LAG FILTER THAT PRECEDES VELOCITY
'    CONTROL
'RESETFLAG% >= 1 CAUSES REINITIALIZATION
'
'***** INITIALIZE ON FIRST PASS THROUGH *****
IF RESETFLAG% >= 1 THEN
        GAIN = 10          'INTEGRAL GAIN
        RESPONSE = 1!      'PROPORTIONAL GAIN/INTEGRAL GAIN
        ALIMPOS = 1400     ' POS TORQUE LIMIT IN ACCELERA-
'                            TION UNITS
        ALIMNEG = 1400     ' NEG TORQUE LIMIT IN ACCELERA-
'                            TION UNITS
        LIMFRAC = .8       'FRACTION OF DRIVE LIMITS CAUSING
'                            DRIVE LIMIT SIGNAL
        TFILTER = .05      'TIME CONSTANT OF LAG FILTER THAT
'                            PRECEDES VELOCITY CONTROL
        EG1 = 0
        CFILT1 = EXP(-DT / TFILTER)
        CFILT2 = 1 - CFILT1
        GAINRESPONSE = GAIN * RESPONSE
```

```
        GAINDT = GAIN * DT
        RESETFLAG% = 0
        AMOLD = 0
        VMOLD = 0
ELSE
        GOTO STARTINTEG
END IF
'
'***** RUN THE INTEGRATION AFTER INITIALIZING *****
'
STARTINTEG:
VFIL = VFIL * CFILT1 + VDICT * CFILT2
E1 = VFIL - VM
EG1 = EG1 + E1 * GAINDT
EG2 = E1 * GAINRESPONSE + EG1
E2 = EG2 - VM
IF E2 <= LIMFRAC * ALIMPOS AND E2 >= -LIMFRAC * ALIMNEG
THEN DRIVELIM = 0 ELSE DRIVELIM = 1
IF E2 <= ALIMPOS AND E2 >= -ALIMNEG THEN AM = E2 ELSE IF
E2 > ALIMPOS THEN AM = ALIMPOS ELSE AM = -ALIMNEG
VM = VM + (AM + AMOLD) * (DT / 2)
AMOLD = AM
XM = XM + (VM + VMOLD) * (DT / 2)
VMOLD = VM
T = T + DT
'
'***** DESCRIPTION OF MODEL ******
'BLOCK DESCRIPTION                          INPUTS     OUTPUTS
'INPUT LAG FILTER;TFILTER=TIME CONSTANT VDICT     VFIL
'SUMMING BLOCK                           VFIL,-VM E1
'PROPORTIONAL CONTROLLER ;GAIN*RESPONSE E1        EG3
'INTEGRAL CONTROLLER ; GAIN*DT           E1        EG1
'SUMMING BLOCK                           EG1,EG3   EG2
'SUMMING BLOCK                           EG2,VM    E2
'LIMITER ;ALIMPOS & ALIMNEG              E2        AM
'INTEGRATOR ; TRAPEZOIDAL INTEG.         AM        VM
'INTEGRATOR ; TRAPEZIODAL INTEG.         VM        XM
'
END SUB
```

Although this invention has been shown and described with respect to detailed, exemplary embodiments thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

I claim:

1. In an elevator speed dictation system for controlling acceleration and deceleration of an elevator, a method of building a table of data during the acceleration of the elevator for use during the deceleration of the elevator, said method comprising the steps of:

integrating a predetermined jerk rate over a plurality of time values to obtain a plurality of dictated acceleration values;

integrating said plurality of dictated acceleration values over the plurality of time values to obtain a plurality of dictated velocity values, said dictated velocity values for use by the speed dictation system for controlling the velocity of the elevator;

determining, for each of said dictated velocity values, a table velocity value based on said dictated velocity value;

determining, for each of said dictated velocity values, a table position value and a table acceleration value based on said dictated velocity value; and storing said table velocity values and said table acceleration values as a function of said table position values for use by the speed dictation system for controlling the deceleration of the elevator.

2. In an elevator speed dictation system for controlling the acceleration and deceleration of an elevator, the method of claim 1, wherein said step of determining a table position value comprises the steps of:

determining a maximum velocity value corresponding to a dictated acceleration value;

comparing said maximum velocity value to said dictated velocity value; and calculating said table position value corresponding to said dictated velocity value based on said comparison.

3. In an elevator speed dictation system for controlling the acceleration and deceleration of an elevator, the method of claim 1, wherein said step of determining a table acceleration value comprises the steps of:

determining a maximum velocity value corresponding to a dictated acceleration value;

comparing said maximum velocity value to said dictated velocity value; and calculating said table acceleration value corresponding to said dictated velocity value based on said comparison.

4. In an elevator speed dictation system, a method for controlling the acceleration and deceleration of an elevator in order to translocate the elevator from a predetermined starting location to a predetermined ending location, said method comprising the steps of:

(a) integrating a predetermined jerk rate to obtain a dictated acceleration value;

(b) integrating said dictated acceleration value over time to obtain a dictated velocity value, said dictated velocity value for use by the speed dictation system for causing the elevator to translocate from the predetermined starting location towards the predetermined ending location;

(c) integrating said dictated velocity value to obtain a dictated position value;

(d) determining distance to go based on the distance between the position of the elevator and the predetermined ending location;

(e) determining distance gone based on the distance between the position of the elevator and the starting location;

(f) determining distance error based on said dictated position value and said distance gone;

(g) determining stopping distance required to stop the elevator based on said dictated velocity value and said dictated acceleration value;

(h) determining compensated distance to go based on said distance to go minus said distance error minus a predetermined value based on system delays;

repeating steps (a) through (h) over time until said stopping distance is at least equal to said compensated distance to go; and decelerating the elevator when said stopping distance is at least equal to said compensated distance to go.

5. In an elevator speed dictation system, the method of claim 4 further comprising the steps of:

determining, for each of said dictated velocity values, a table velocity value based on said dictated velocity value;

determining, for each of said dictated velocity values, a table position value and a table acceleration value based on said dictated acceleration value; and storing said velocity values, said table position values and said table acceleration values for use by the speed dictation system for decelerating the elevator.

6. In an elevator speed dictation system, the method of claim 5, wherein the step of determining a table position value comprises the steps of:

determining a maximum velocity value corresponding to a dictated acceleration value;

comparing said maximum velocity value to said dictated velocity value; and calculating said table position value corresponding to said dictated velocity value based on said comparison.

7. In an elevator speed dictation system, the method of claim 5, wherein said step of determining a table acceleration value comprises the steps of:

determining a maximum velocity value corresponding to a dictated acceleration value;

comparing said maximum velocity value to said dictated velocity value; and calculating said table acceleration value corresponding to said dictated velocity value based on said comparison.

8. In an elevator speed dictation system, the method of claim 5, wherein the step of decelerating the elevator comprises the steps of:

determining the distance to go to the predetermined ending location when the elevator commences said deceleration;

comparing said commence-deceleration distance to go with the most recently stored table position value;

determining a scaling factor based on said comparison;

reading at least a portion of said stored values of table velocity and table acceleration from the table as a function of said table position value;

interpolating said read values of table velocity and table acceleration based on said scaling factor;

dictating a velocity value and an acceleration value to the elevator based on said interpolated velocity value and said interpolated acceleration value respectively.

9. In an elevator speed dictation system, the method of claim 5, wherein the step of decelerating the elevator comprises the steps of:

(a) determining the distance to go to the predetermined ending location when the elevator commences said deceleration;

(b) comparing said commence-deceleration distance to go with the most recently stored table position value;

(c) determining a multiplication factor based on said comparison;

(d) determining a compensation factor based on system delays and a predetermined washout factor;

(e) determining look-ahead distance to go based on said distance to go, said compensation factor and said multiplication factor;

(f) reading at least a portion of said stored values of table velocity and table acceleration from the table;

(g) interpolating said read values of table velocity and table acceleration based on said look-ahead distance to go;

(h) dictating a velocity value and an acceleration value to the elevator based on said interpolated velocity value and said interpolated acceleration value, respectively.

10. In an elevator speed dictation system, the method of claim 9, wherein said washout factor is a function of distance to go.

11. An elevator speed dictation system comprising:

a profile generator for outputting a target velocity signal and a target acceleration signal;

summing means for adding said target velocity signal and said target acceleration signal to obtain a velocity dictation signal;

an elevator motion system including a motor drive system for receiving said velocity dictation signal and translocating an elevator based thereon; and a position sensor for measuring the current position of the elevator and outputting an elevator position signal;

said profile generator for receiving said elevator position signal and a target position signal indicative of a desired final location of the elevator, said profile generator generating said target velocity signal and said target acceleration signal based on said target position signal and said elevator position signal.

* * * * *

UNITED STATES PATENT AND TRADEMARK OFFICE

CERTIFICATE OF CORRECTION

PATENT NO. : 5,035,301

DATED : July 30, 1991

INVENTOR(S) : Clement A. Skalski

It is certified that error appears in the above-identified patent and that said Letters Patent is hereby corrected as shown below:

In Column 4, line 32 after the word "begun", please insert --.--;

same Column, line 40 after the word "system", please insert --.--.

In Column 5, line 41, please delete "vD" and insert --VD-- in lieu thereof;

same Column, line 61, after the word "drive", please insert --.--.

In Column 9, line 49, please delete "VD" and insert --$VD_n$-- in lieu thereof;

same Column, line 51, please delete "9".

In Column 10, line 11 after "(LADTG)", please insert --.--;

same Column, line 34 after "DISTTG", please insert --.--;

same Column,line 39 after "(1 to 0)", please insert --.--;

same Column, line 46, please delete "+" and insert --÷-- in lieu thereof.

In Column 11, line 52 after "multiply;" please insert --^--.

UNITED STATES PATENT AND TRADEMARK OFFICE

CERTIFICATE OF CORRECTION

PATENT NO. : 5,035,301

DATED : July 30, 1991

INVENTOR(S) : Clement A. Skalski

It is certified that error appears in the above-identified patent and that said Letters Patent is hereby corrected as shown below:

In Column 33, line 64, please delete the word "the" and insert --said-- in lieu thereof.

Signed and Sealed this

Second Day of February, 1993

*Attest:*

STEPHEN G. KUNIN

*Attesting Officer*

*Acting Commissioner of Patents and Trademarks*